United States Patent [19]

Capano et al.

[11] 4,163,408

[45] Aug. 7, 1979

[54] MUSICAL TUNING DEVICE

[76] Inventors: Philip S. Capano, 2785 Sedgwick Ave., Bronx, N.Y. 10468; David Capano, 79 Lake Ave., Saratoga Springs, N.Y. 12866

[21] Appl. No.: 730,754

[22] Filed: Oct. 7, 1976

[51] Int. Cl.[2] ..... G10G 7/02

[52] U.S. Cl. ..... 84/454

[58] Field of Search ..... 84/454

[56] References Cited

U.S. PATENT DOCUMENTS

| | | | |
|---|---|---|---|
| 2,901,699 | 8/1959 | Motz et al. | 84/454 |
| 3,280,937 | 10/1966 | Faber et al. | 84/454 |
| 3,472,116 | 10/1969 | Schott | 84/454 |
| 3,766,818 | 10/1973 | Prohofsky | 84/454 |
| 3,795,169 | 3/1974 | Belcher | 84/454 |
| 4,078,469 | 3/1978 | Calvin | 84/454 |

FOREIGN PATENT DOCUMENTS

| | | | |
|---|---|---|---|
| 1213794 | 11/1970 | United Kingdom | 84/454 |

*Primary Examiner*—Lawrence R. Franklin

[57] ABSTRACT

A tuning device for use in tuning a musical instrument includes sensing means operable for sensing a first electrical signal having a certain frequency bandwidth and corresponding to an acoustical musical note produced by the musical instrument, filtering means coupled to the sensing means and operable for filtering the first signal to produce a second electrical signal having a substantially smaller frequency bandwidth, the second signal being representative of the musical note, dividing means coupled to the filtering means and operable for dividing the frequency of the second signal to produce a third electrical signal, generating means operable for producing a reference electrical signal representative of a musical note for tuning the musical instrument, and comparing means coupled to the dividing means and the generating means and operable for comparing the third signal and the reference signal to each other and for producing a fourth electrical signal when the third signal is within a predetermined frequency range from the reference signal. The filtering means is optional for relatively narrow frequency band instruments, such as a piano.

3 Claims, 5 Drawing Figures

MUSICAL TUNING DEVICE

BACKGROUND OF THE INVENTION

The invention relates to a tuning device for use in tuning a musical instrument.

Both skilled and relatively unskilled musicians have long realized the importance of tuning the instruments for both individual and group performances. Many of the prior art tuning devices have relied considerably on the judgment of a person carrying out the tuning process. For these devices, a musical note is audibly produced and the person carrying out the tuning compares this reference note to a note produced by the musical instrument.

Some prior art tuning devices include complex mechanical moving parts and are awkward to use and inconvenient to transport. More recently, some highly sophisticated tuning devices have been introduced such as the device which is covered by U.S. Pat. No. 3,861,266. This patented device is basically an electronic means for producing an audible reference note.

The instant invention allows a signal representing a musical note to be compared electronically to a reference signal and the results of that comparison displayed.

In addition, the instant invention has the capability of having its reference notes aligned to musical notes produced by a musical instrument so that other musical instruments can be tuned to be harmonious therewith. This has use in the case of a group of musicians who want to tune their musical instruments such as guitars to be agreeable with a piano which might be somewhat out of tune.

SUMMARY OF THE INVENTION

One of the principle objects of the invention is a tuning device for use in tuning a musical instrument, including sensing means operable for sensing a first electrical signal having a certain bandwidth and corresponding to an acoustical musical note produced by the musical instrument, filtering means coupled to the sensing means and operable for filtering the first signal to produce a second electrical signal having a substantially smaller frequency bandwidth, the second signal being representative of the musical note, dividing means coupled to the filtering means and operable for dividing the frequency of the second signal, generating means operable for producing a reference electrical signal representative of a selected musical note for tuning the musical instrument, and comparing means coupled to the dividing means and the generating means and operable for comparing the third signal and the reference signal to each other and for producing a fourth electrical signal when the third signal is within a predetermined frequency range from the reference signal.

The filtering means is optional for devices to be used for relatively narrow frequency band instruments, such as pianos.

Further objects and advantages of the invention will be set forth in the following specification and in part will be obvious therefrom without being specifically referred to, the same being realized and attained as pointed out in the claims hereof.

The invention accordingly comprises the features of construction, combination of elements and arrangement of parts which will be exemplified in a construction hereinafter set forth and the scope of the application of which will be indicated in the claims.

BRIEF DESCRIPTIONS OF THE DRAWINGS

FIG. 1 is a block diagram showing generally a musical tuning device according to the instant invention, and FIGS. 2 to 5 are a detailed system block diagrams of an embodiment of the instant invention.

DESCRIPTION OF THE PREFERRED EMBODIMENTS

In carrying the invention into effect, some of the embodiments have been selected for illustration in the accompanying drawings and for description in this specification, referring now particularly to FIGS. 1 to 5.

Figure 1:
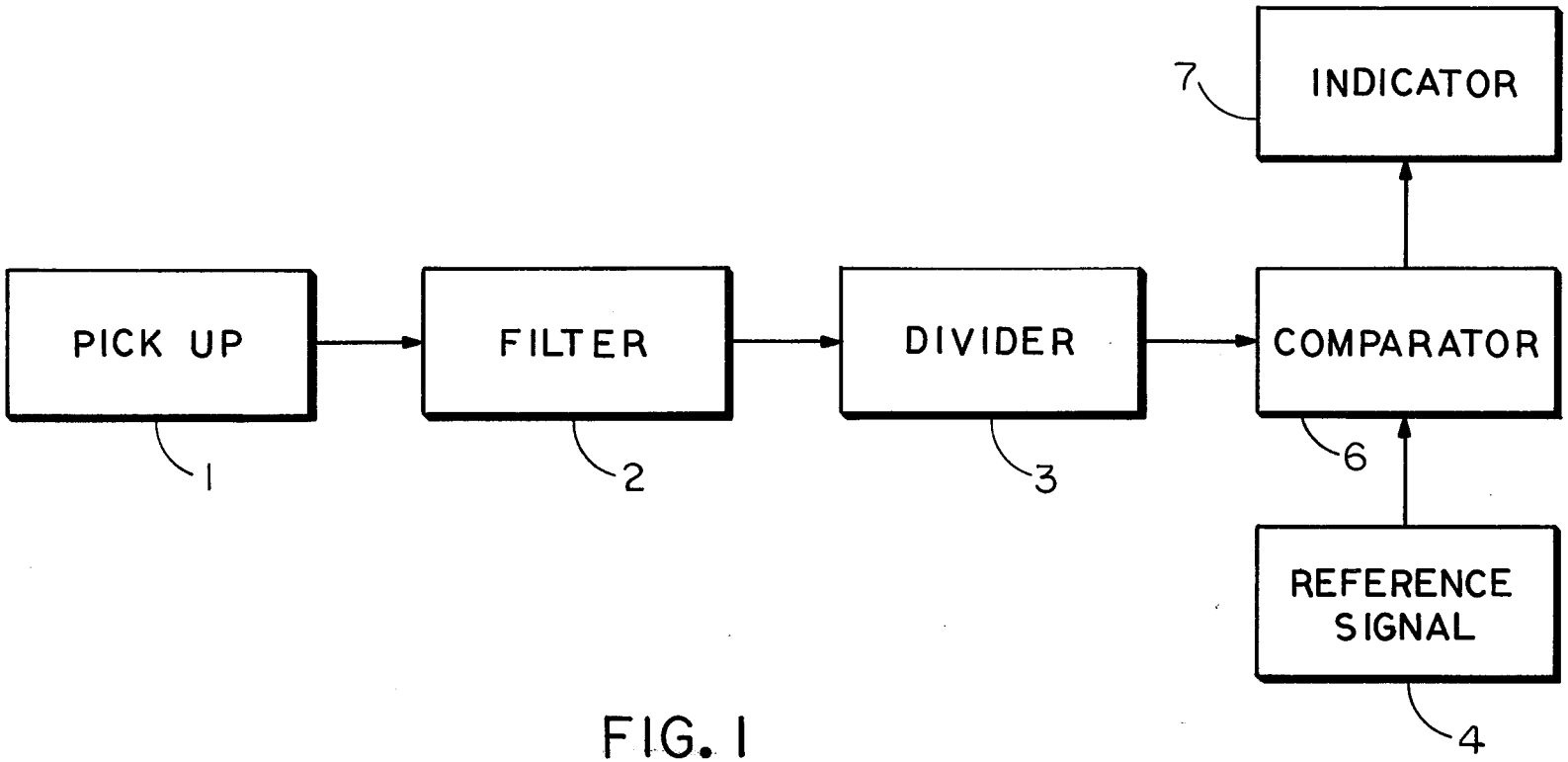
Figure 2:
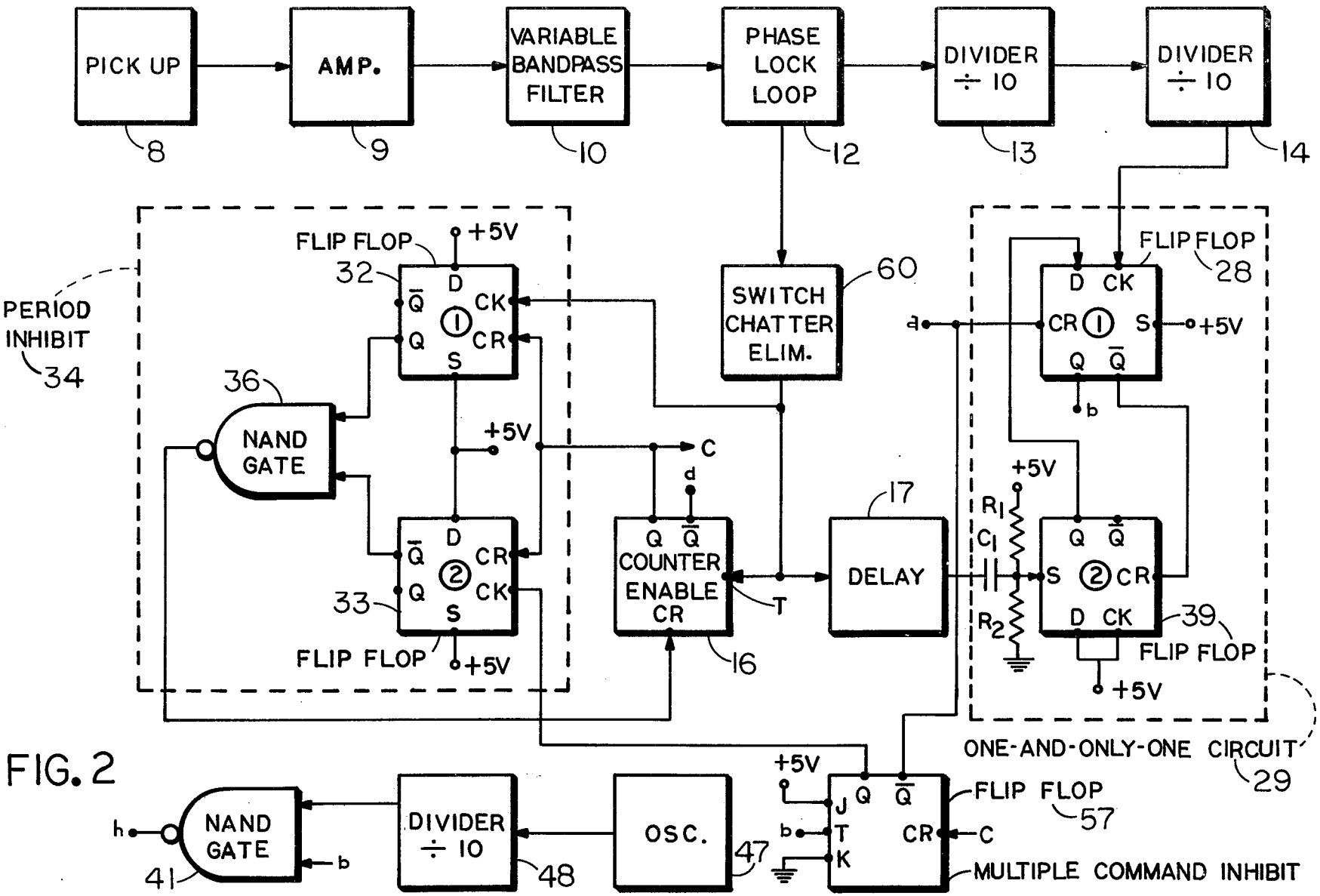
Figure 3:
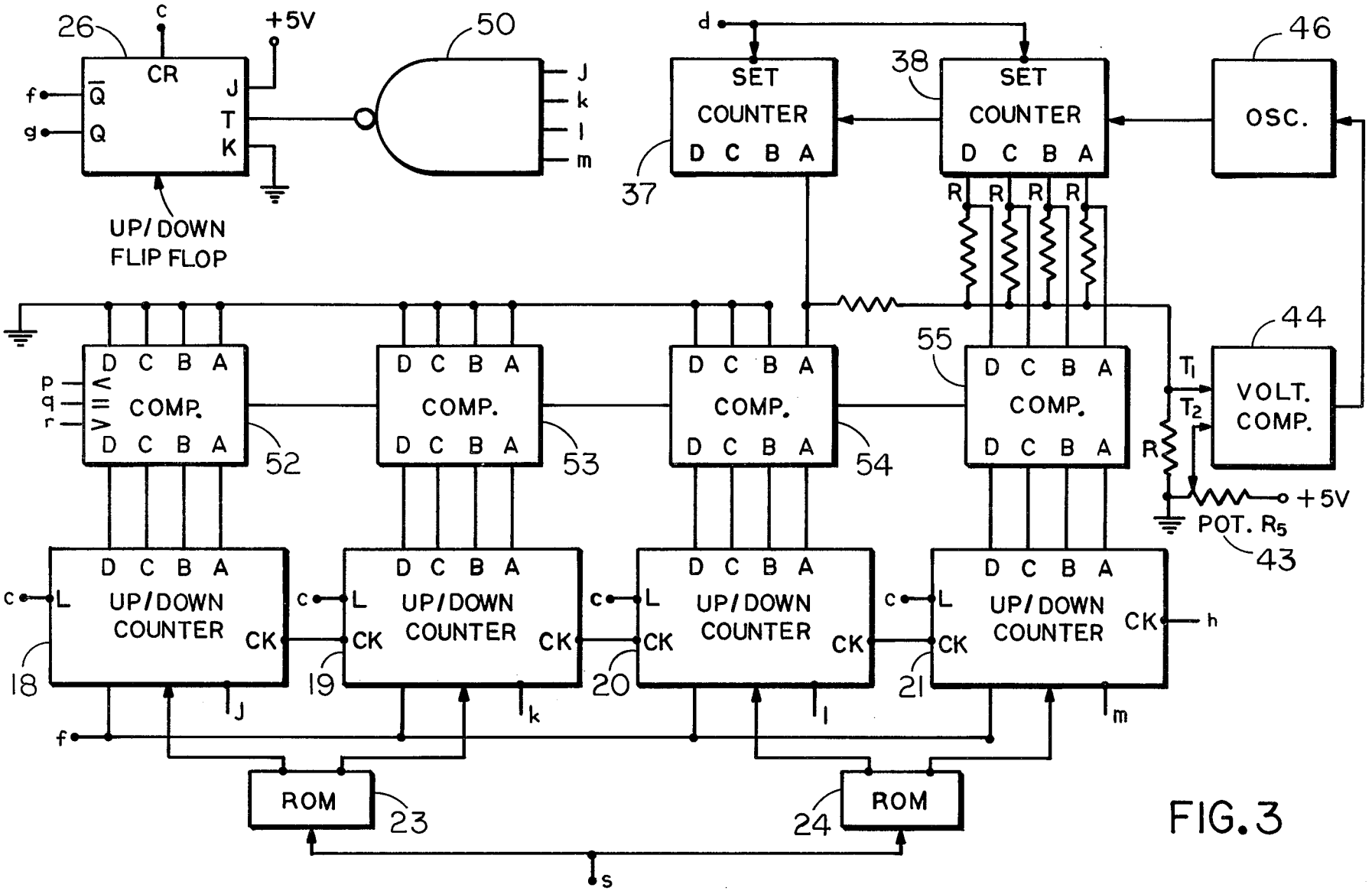
Figure 4:
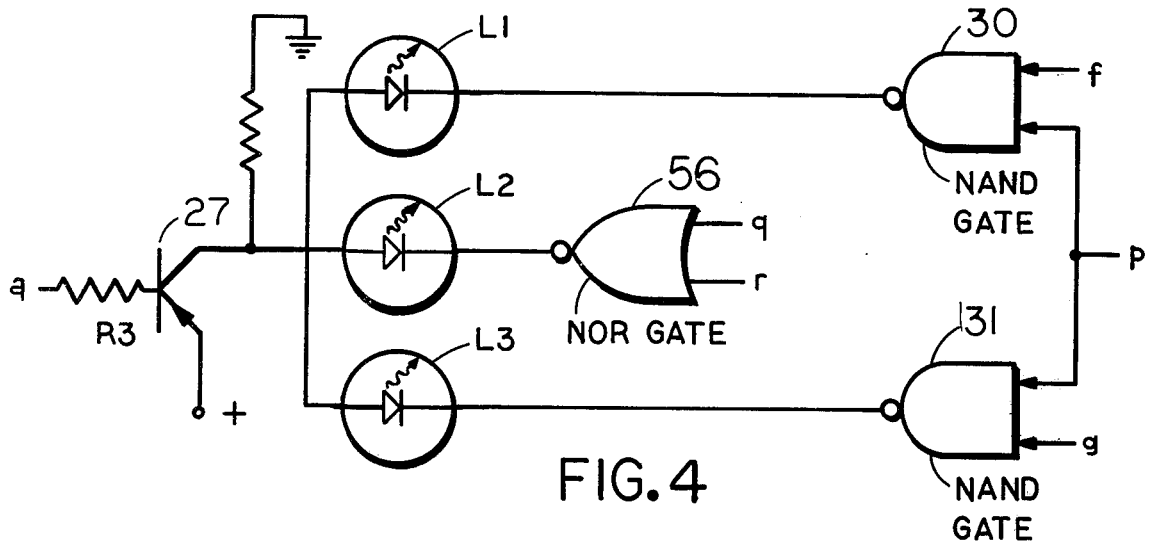
Figure 5:
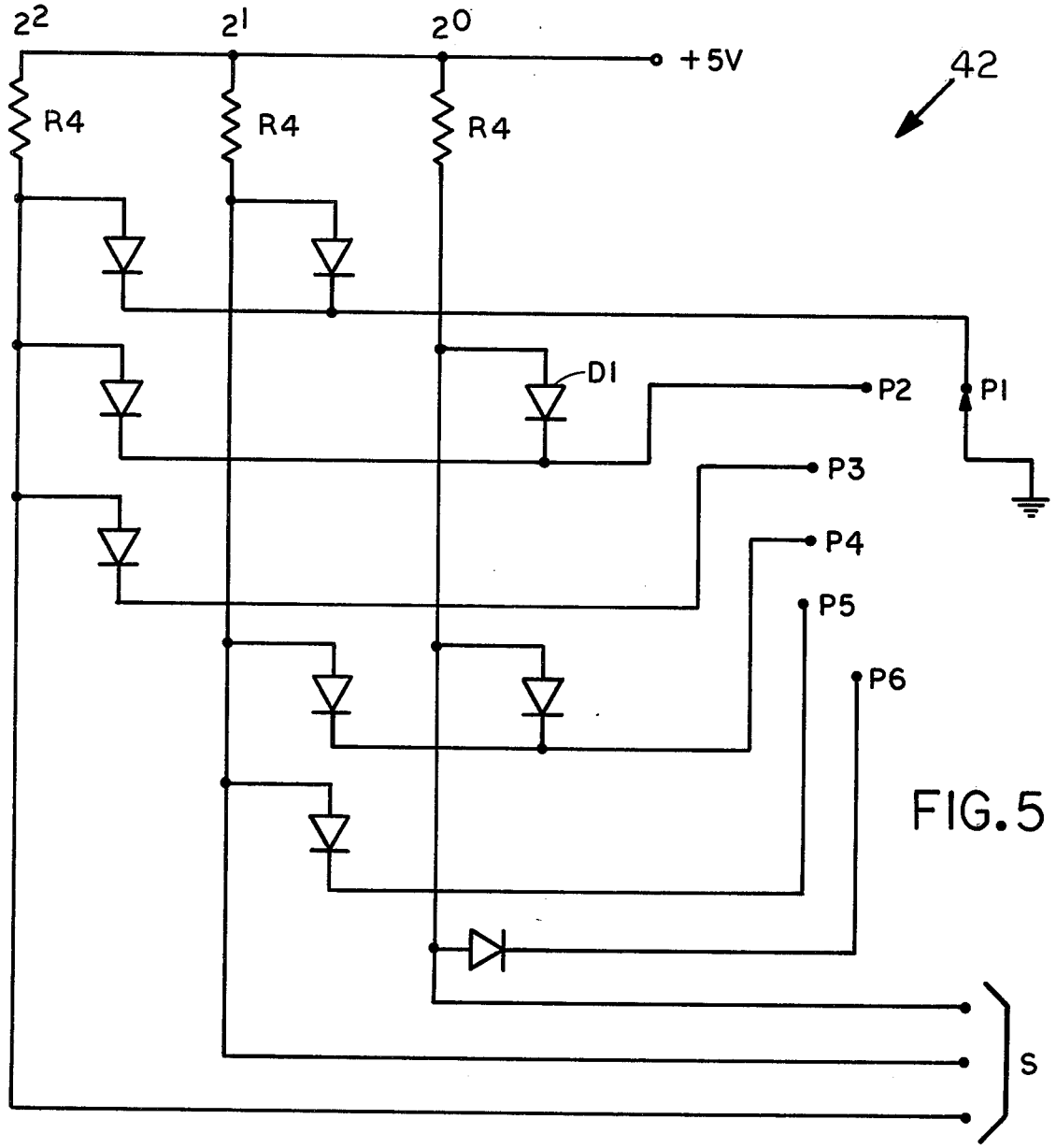

FIG. 1 shows the broad concept of the instant invention. Sensing means such as pick-up 1 is operable for sensing a first electrical signal having a certain frequency bandwidth and corresponding to an acoustical note produced by a musical instrument. The pick-up 1 can include a microphone for transforming acoustical vibrations into an electrical signal or it can be means to couple into an electrical signal as in the case of an electronic organ. That is, the pick-up 1 can couple into the electrical signal of an electronic organ which produces the acoustical sound rather than use of a microphone to pick up the acoustical sound and convert it into an electrical signal.

Generally, a filter 2 is needed in order to filter the first signal for subsequent operations. For some instruments, the first signal can be rich and harmonic and the presence of strong harmonics might interfere with the accuracy of the tuning device or might require additional circuitry to avoid such interference. In the case of a piano, the notes are primarily the fundamental so that the filter 2 might not be needed for the tuning device to tune the piano.

The filter 2 narrows or selects a predetermined frequency for the selected musical note. This could be the fundamental or even the second harmonic. In the case of a guitar, it is known that the second harmonic is relatively strong so that the second harmonic could be used instead of the fundamental or it might be desirable to include in the filter 2 a notch filter to particularly attenuate the second harmonic and thereby simplify the selective filtering of the fundamental. The output signal of the filter 2 is a second electrical signal having a substantially smaller frequency bandwidth than the first signal.

A dividing means such as divider 3 divides down the second signal to produce a third electrical signal. The divider 3 can be a fixed divider or variable divider such as a programmable divider, depending upon the embodiment selected.

If the divider 3 is a fixed divider, then the subsequent system blocks must include a group of reference signals corresponding to the various musical notes of the musical instrument so that the third signal can be compared to the proper reference signal representing the desired musical note.

Alternately, the divider 3 can be a variable divider which selectively divides down the second signal for comparison to a fixed reference signal.

Generating means such as reference signal 4 is operable for producing a reference electrical signal representative of a selected musical note for tuning the musical instrument. The divider 3 and the reference signal 4 are coupled to comparator 6. The comparator 6 is operable for comparing the third signal and the reference signal to each other and for producing a fourth electrical signal when the third signal is within a predetermined frequency range from the reference signal.

An indicating means such as indicator 7 is coupled to the comparator 6 and is responsive to the fourth signal for indicating the results of the comparison. The indicator 7 can be in the form of a meter showing the value of the frequency of the third signal with respect to the reference signal or it can take the form of three indicator lights: one light to show that the third signal is within a predetermined frequency range from the reference signal, a second light to show when the third signal is sharp, and a third light to show when the third signal is flat. The indicator 7 can also be used to show the actual frequency difference.

The embodiment shown in FIG. 1 has the following advantages: it is suitable for construction with integrated circuits and in the case of CMOS circuits it can be made to operate from batteries for extended periods of time and is light weight and is easily portable. In addition, accuracies in the order of $\pm\frac{1}{3}$ cent is possible and reliably obtained. The use of solid state circuitry eliminates moving parts and enhances the rugged and reliable operation.

If filter 2 is an active filter or particularly a phase lock loop filter, then musical instruments having rich musical notes, that is, substantial harmonics, can be tuned without any ambiguity.

The system shown in FIG. 1 also can be made to retain an output state or display even after the note of the musical instrument has substantially died out in order to simplify the tuning of musical instruments.

FIGS. 2 to 5 are a block diagram of another preferred embodiment. The interconnections between the figures is indicated by the use of lower case letters of the alphabet.

Two types of flip flops are used in the FIGS. 2 to 5: the positive edge-triggered D type flip flop and the J-K master-slave level-triggered flip flop. The distinctions between these flip flops are well known in the art but some of these general distinctions will be set forth hereinafter.

In the case of the D flip flop, information on the data input terminal D is transferred to the Q output terminal only when the clock input terminal C changes from a low to a high level. That is, triggering occurs only on the positive clock edge. A terminal $\overline{Q}$ shows the logical complement of Q. During normal operation, the clear and set input terminals are at high levels. If the clear input terminal is forced to a low level (grounded), the flip flop immediately goes into the state with Q low. If the set input terminal is grounded, the flip flop immediately goes into the state Q high. The clear and set terminals cannot be in low state at the same time.

In the case of the J-K master-slave flip flop, the Q and $\overline{Q}$ can change only when the clock input terminal C, also called the trigger or T input terminal, changes from a high to a low level. That is, the triggering is level-sensitive and not edge-sensitive. In addition, the change which occurs depends upon the states of the J and K input terminals. If both the J and K input terminals are at high levels, then the Q and $\overline{Q}$ output terminals change states whenever the T input terminal changes to the low level. If the J terminal level is high and the K terminal is low then clocking makes the Q terminal go to a high state. If the J terminal is low and the K terminal is high then clocking makes the Q terminal low. If both the J and K terminals are low then the clocking makes no change in state. During normal operation, the clear input terminal is kept high. If the clear input terminal is grounded, the flip flop immediately goes into the state with the Q terminal low.

Pick-up 8 is typically an acoustic or magnetic pick-up or the like. The use of a small microphone in contact with an acoustic guitar almost totally prevents ambient noise from causing a triggering of the circuit. The use of a magnetic pick-up with an electric guitar totally eliminates false triggering from ambient noise.

Amplifier 9 matches the output impedence of the pick-up 8 and amplifies the electrical signal representing a musical note from the musical instrument being tuned. Variable bandpass filter 10 is a passive or active filter having a center frequency substantially the same as the frequency of the musical note being tuned. The filter 10 can also include a notch filter for attenuating expected strong harmonics. A guitar is known to be generally rich in second harmonics.

The use of phase lock loop 12 is an important feature of the instant invention. Generally, phase lock loops are well known in the electronics field and typically include a voltage controlled oscillator (VCO) to lock onto and track an input signal. The experimental model of the instant invention used a commercially available phase lock loop, namely the LM 567 because in addition to providing the input signal as a digitally conditioned first output, it also includes (in order to satisfy its primary function as a frequency decoder) lock detection circuitry which causes a change in voltage level from 5 volts to 0 volts in a second output when an input signal lies within its amplitude and frequency detection band. To effect lock detection, the LM 567 employs an auxiliary or Quadrature Phase Detector to directly drive a power output stage. Details of the Quadrature Detector's operation can be acquired by referring to suitable data sheets for this type of PLL; such data is available, for example, from the Signetics Company. It was found that, occasionally, during lock-on, chatter, in the form of multiple transitions to, and from, the 0 and 5 volt levels, occured for the first $\frac{1}{4}$ millisecond in the Quadrature Detector's switching output stage. To compensate for this problem, a switch chatter eliminator, in the form of a non-retriggerable Monostable Multivibrator, having a pulse duration of several milliseconds, was added to the output stage.

The VCO output of Phase Lock Loop 12 is coupled over to divider 13 where it is divided by "10" and the resulting signal is coupled to divider 14 where it is again divided by "10". The dividers 13 and 14 divide digitally. Counter enable 16 and Delay 17 are non-retriggerable Monostable Multivibrators. For both devices, the stable state is with the Q terminal low. It is with the transition from a high to a low level of the output of the Switch Chatter Eliminator, indicating that a qualified input signal has been acquired by the lock detection circuitry of the PLL that Counter Enable 16 and Delay 17 are forced into their unstable states with the Q terminal high.

When the counter enable 16 is in its stable state, the following conditions exist: the Q output signal places a low level on the load input terminal of up/down counters 18, 19, 20, and 21. This enables the output numbers from the read only memories (ROM) 23 and 24 to be loaded into the counters 18, 19, 20, and 21. A low signal is applied to the clear input terminal of the flip flop 57, which is designated the Multiple Command Inhibit, and which serves to prevent multiple PLL lock detections from being acted upon during that time when a measurement has been completed and the result of that measurement is being displayed. This low signal sets the Q output terminal of the flip flop 57 to a low and the $\overline{Q}$ output terminal to a high. The high signal at the $\overline{Q}$ output terminal disables the switching transistor 27 and thereby prevents light emitting diodes (LED) L1, L2, and L3 from lighting and forces the clear terminal of flip flop 28 to a high level which is a normal state for one-and-only-one circuit 29. In addition, a low on the clear input terminal of the flip flop 26 sets its Q low and, of course, the $\overline{Q}$ high. This $\overline{Q}$ output signal places a high on the input terminals of the counters 18, 19, 20, and 21 to force these counters into a down counting mode. The $\overline{Q}$ output also enables the NAND gate 30. The Q output signal disables the NAND gate 31. Simultaneously, a low is applied to the clear input terminals of the flip flops 32 and 33 of the period inhibit 34 to force their Q output terminals to low along with the $\overline{Q}$ output terminals to high states. With one input terminal low and the other input terminal high, the NAND gate 36 has a high at its output terminal. This high signal is applied to the counter enable 16 to allow it to operate normally.

The $\overline{Q}$ output terminal of the counter enable 16 places a high on the zero set input terminals of the counters 37 and 38 and, by loading zeros, this action clears the counters 37 and 38.

The one-and-only-one circuit 29 includes flip flops 28 and 39, resistors, R1 and R2, and capacitor C1. This block converts the random, high-to-low transition signal from Delay 17 into an extremely precise time gate, synchronized to the rising edges of the clock train from Divider 14, and lasting for one, and only one, interval between clock pulses. Before the arrival of a command signal, the Q output terminal of the flip flop 28 is low. A command in the form of a change from high to low is applied by the delay 17 and changes Q of the flip flop 39 to high. This high is applied to the D input terminal of the flip flop 28 so that the high is passed to the Q output terminal of the flip flop 28 on the next low to high edge of the clock pulse. With the Q of the flip flop 28 high, its $\overline{Q}$ terminal becomes low and this is applied to the clear input terminal of the flip flop 39 to change its Q to a low state. This low state is applied to the D terminal of the flip flop 28 and passes to the Q terminal on the next up-clock. At that time, the one-and-only-one circuit 29 has returned to its initial state and has generated a high level gate for a time equal to one period of the clock.

The delay 17 is about 50 milliseconds in order to allow excitation of the peripheral circuits and to allow a settling of the phase lock loop 12 before counting begins and circuit 29 begins its action.

The one-and-only-one circuit 29 enables one input terminal of the NAND gate 41 for exactly 100 periods of the input signal. The input signal depends upon the note that is being tuned. This is determined by the position of the switch 42 which includes diodes D1 and resistors R4. The switch 42 is for the selection of guitar notes. If the sixth string or low E note of the guitar were being tuned, then the switch 42 would be in the position P6. If it is assumed that the low E note is being tuned, then the switch 42 would mechanically or electrically select the bandpass for the bandpass filter 10 and filter section for the phase lock loop 12. In this case, the center frequency is about 164.8 Hz (down $3_{db}$ at $\pm 15$ Hz). The switch 42 would also place a ground on the cathode of the diode located at the 2° position which would cause the address lines of the read only memories 23 and 24 to generate binary code 110.

In this case, the code 110 would produce the word 6068 which represents in microseconds the period corresponding to the frequency 164.8 Hz. The frequency 164.8 Hz corresponds to the frequency of the second harmonic of the low E note. If the fundamental of the low E note were used instead, then the circuits would be tuned for 82.4 Hz or 12,136 microseconds. A sampling time of about 0.6 seconds requires dividers that divide by a factor of about 50. Basically, the calculations are:

$$T\text{ (one period)} = 1/82.4\text{ Hz} = 12{,}136\text{ microsec.}$$

$$T\text{ (gating)} = 50(12{,}136\text{ microsec.}) = 0.6068\text{ sec.}$$

Generally, any sampling time under one second is suitable and the divider need not be fixed at 100.

The counter enable 16 in its stable state loads the counters 18, 19, 20. and 21 to the word 6068. A change in the accuracy for tuning to the selected note can be made by varying the potentiometer 43. This affects the tuning as follows:

The high level from the $\overline{Q}$ from the counter enable 16 is applied to the counters 37 and 38 so that these counters are cleared and hold zeros. As a result, no analogue voltage develops at terminal $T_1$ of the voltage comparator 44.

If the voltage at terminal $T_2$ is greater than zero, then the comparator 44 puts out a high level which allows the inhibitable oscillator 46 to oscillate.

When a low signal arrives at the zero set input terminals of the counters 37 and 38 as a result a change of state of the counter enable 16, then the counters 37 and 38 begin to count the pulses of the oscillator 46. The increasing count develops a proportional analogue voltage at the terminal $T_1$ which is essentially a digital to analogue conversion at the rate of about 50 mV per count until a level of no more than that is reached above the voltage at the terminal $T_2$. At this count, the comparator 44 changes its state and places a low signal on the inhibit input terminal of the oscillator 46. A number between 0 and 19 can be selected depending upon the value of the potentiometer R5.

Returning to the NAND gate 41, there is applied to its other input terminal a precision frequency from oscillator 47 which has been divided by the divider 48. The oscillator 47 is a crystal controlled oscillator set at 100.000 KHz. This oscillator forms a basis of the tuning accuracy and includes a provision of a variable capacitor or the like for pulling the crystal frequency by up to $\pm 1000$ Hz so that the tuner itself can be calibrated to a relatively fixed-tuned instrument such as a piano which has, as a whole, drifted from concert pitch. Once calibrated, the tuner can be used to tune other instruments to be in agreement with the piano.

For the tuning of the E, 100 periods of the input signal are passed by the NAND gate 41. If the guitar E is precise then the gating lasts 0.6068 second. The NAND gate 41 is coupled to counters 18, 19, 20, nd 21 and causes them to count down. At the end of this counting, four possibilities can exist depending upon the actual tuning of the E note:

(1) at the end of the count, there can be a residual count left which is greater than the tuning tolerance and indicates that the guitar note is too sharp;

(2) the count can be less than or equal to 6068 yet, at the end of the count there can be a residual count within the predetermined tuning tolerance, indicating the pitch is somewhat sharp but within the predetermined limits;

(3) the count can be greater than 6068 yet leave a residual count within the tuning tolerance, indicating a pitch somewhat flat but within the predetermined tolerance;

(4) the count can be much greater than 6068 to indicate the note is too flat.

For the last two cases, the following circuitry processes counts in excess of 6068. As soon as the count in the counters 18, 19, 20, and 21 reach zero, the NAND gate 50 acts as a zero detector by sensing the four simultaneous high level output signals. This results in a change from a high to a low output level of the NAND gate 50 to be applied to the T input terminal of the flip flop 26 which makes its Q high and $\overline{Q}$ low. This forces the counters 18, 19, 20, and 21 input terminals to low levels and places them in the up-counting mode. Because these counters are counting up, the pulse after "0", that is, the 6069th signal pulse in this example generates a count of 0001. Subsequent pulse signals continue the count. In addition, the NAND gate 31 is enabled while NAND gate 30 is disabled.

For these four cases, the residual count is processed by the comparators 52, 53, 54, and 55. For case (1), if the predetermined tolerance were 08 and the residual count were greater, say 11, then the "less than" output terminal of the most significant comparator would be high with the "equal" and "greater than" terminals being low. This would cause the NAND gate 30 to have a low level output signal because its other input terminal is at a high level from the flip flop 26. This allows the LED L1 to light when the transistor 27 is switched on.

In the case (2), the comparison makes either the "equal" or "greater than" output terminal go to a high level and the "less than" becomes a low level. This causes the NOR gate 56 to have a low output signal so that the LED 12 will light when the transistor 27 is turned on. The case (3) is the same as the case (2).

The case (4) is similar to the case (1) except that the flip flop 26 enables the LED L3.

It is only when the 100 period gate ends and triggers the flip flop 57 that the transistor 27 is enabled or switched on to light one of the LEDs L1, L2 or L3. The triggering of the flip flop 57 also places a low signal on the clear input terminal of the flip flop 28 to force its Q output terminal low and prevent additional outside commands from affecting the established count.

The period inhibit 34 quickly resets the circuitry if an invalid count is sensed. Logically, the input tone or note must maintain the phase lock loop 12 in a locked condition for a time sufficient for the determination of its frequency. The criterion is whether, or not, the low dechattered lock detection level (again, this level is low when the PLL is in lock but high otherwise) snaps high before the completion of the 100 period gate. If it does, then the period inhibit 34 couples a pulse signal (high-low-high) which clears the counter enable 16 and returns the circuitry to the "ready" state. If it remains low, then a valid count is assumed and the period inhibit 34 allows the completion of the counter enable 16 "on" time. The lock detection output stage is coupled to the switch chatter eliminator 60.

It is of interest that the output signal from the comparing means can be used in conjunction with an electromechanical system for automatically tuning a musical instrument. Such a feed back loop can incorporate prior art technology.

We wish it to be understood that we do not desire to be limited to the exact details of construction shown and described, for obvious modifications will occur to a person skilled in the art.

We claim:

1. A tuning device for use in tuning a musical instrument, comprising:

sensing means operable for sensing a first electrical signal having a certain frequency bandwidth and corresponding to an acoustical musical note produced by said musical instrument;

frequency decoding means coupled to said sensing means and operable for (1) producing a second signal when said first signal lies within a predetermined frequency and amplitude detection range, and (2) producing a third signal by transforming the said first signal into a digital pulse train having a period equal to the fundamental period of the said first signal;

synchronizing means coupled to said frequency decoding means and operable for producing, upon the random occurence of the said second signal and, by synchronization to the said third signal, a precise time gate signal equal in duration to a predetermined number of periods of the said third signal;

generating means, comprised of monolithic, semiconducting, read-only-memories (ROM's) and operable for producing a digital reference number representative of a selected musical note for tuning said musical instrument;

tuning tolerance means operable for converting a variable, user-selected potentiometer setting into a digital tolerance number representative of the limits, about perfect pitch, within which, the said first signal, after processing by the means herein claimed, is determined to be in tune;

digital processing means coupled to said generating means, said synchronizing means, and said tuning tolerance means and comprised of:

a digital pulse generator operable for producing pulse signals, gating means coupled to said pulse generator and said synchronizing means and operable for producing a truncated pulse train by passing said pulse signals for the duration of the said time gate signal produced by said synchronizing means, down/up counting means coupled to said gating means and said generating means and operable for producing a residual digital count by causing each pulse of the pulse train produced by the said gating means to exhaustively decrement a down/up counter which has been pre-loaded to the said digital reference number of said generating means, with the condition that, should the counter decrement through zero, each subsequent, remaining pulse of the pulse train, now exhaustively increments the said counter, magnitude comparing means coupled to said down/up counting means and said tuning tolerance means and operable for comparing the said residual digital count produced by said down/up counting means and the said digital tolerance number produced by said tuning tolerance means to produce (1) an "in tune" signal whenever the said residual digital count is numerically less than, or equal to, the said digital tolerance number, or (2) a "flat" signal whenever the said residual count is numerically greater than the said digital tolerance number and the said down/up counter has decremented through zero, or (3) a "sharp" signal whenever the said residual digital count is numerically greater than the said digital tolerance number and the said down/up counter has not decremented through zero, said digital processing means processing the said digital reference number by a counting action, under the control of the said time gate signal and, by numerical comparison with the said digital tolerance number, produces a one-of-three signal;

displaying means configured as three vertically aligned light emitting diodes (LED's), coupled to said digital processing means and operable to (1) illuminate the center LED whenever the said digital processing means produces an "in tune" signal, or (2) illuminate the lower LED whenever the said digital processing means produces a "flat" signal, or (3) illuminate the upper LED whenever the said digital processing means produces a "sharp" signal;

monitoring means coupled to said frequency decoding means, said synchronizing means, and said displaying means and operable for producing, should the said second signal terminate prior to the completion of the said time gate signal, (1) a fourth signal, and (2) a blanking signal to, and causing, said displaying means to extinguish any illuminated LED;

initialization means coupled to said monitoring means, said tuning tolerance means, and said digital processing means and operable to initialize and "restart" these stated means whenever said monitoring means produces the said fourth signal.

2. The device as claimed in claim 1, wherein said frequency decoding means comprises a narrowband phase locked loop having auxiliary lock detection circuitry and output stage.

3. The device as claimed in claim 1, wherein said generating means is comprised of monolithic, semiconducting, random-acess-memories (RAM's).

* * * * *